US010582297B2

(12) United States Patent
Wang et al.

(10) Patent No.: US 10,582,297 B2
(45) Date of Patent: Mar. 3, 2020

(54) SPEAKER BOX

(71) Applicant: AAC Technologies Pte. Ltd., Singapore (SG)

(72) Inventors: Wu Wang, Shenzhen (CN); Liang Zhang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/236,395

(22) Filed: Dec. 29, 2018

(65) Prior Publication Data

US 2019/0215600 A1 Jul. 11, 2019

(30) Foreign Application Priority Data

Jan. 5, 2018 (CN) ..... 2018 1 810012546

(51) Int. Cl.
*H04R 1/28* (2006.01)
*H04R 1/02* (2006.01)

(52) U.S. Cl.
CPC ..... *H04R 1/288* (2013.01); *H04R 1/023* (2013.01); *H04R 1/025* (2013.01); *H04R 1/2811* (2013.01); *H04R 1/021* (2013.01); *H04R 2201/029* (2013.01); *H04R 2499/11* (2013.01)

(58) Field of Classification Search
CPC ..... H04R 1/288; H04R 1/023; H04R 1/025; H04R 1/2811; H04R 1/021; H04R 2201/029; H04R 2499/11
USPC ..... 381/334, 351, 354
See application file for complete search history.

(56) References Cited

U.S. PATENT DOCUMENTS 8,848,961 B2 * 9/2014 Huang ..... H04R 1/2807 381/351
9,838,765 B1 * 12/2017 Li ..... H04R 1/023
2008/0219490 A1 * 9/2008 Yang ..... H04R 1/2842 381/351
2009/0190783 A1 * 7/2009 Yang ..... H04R 1/28 381/337
2009/0190788 A1 * 7/2009 Yang ..... H04R 1/021 381/386
2013/0170688 A1 * 7/2013 Cohen ..... H04R 1/30 381/340
2015/0110327 A1 * 4/2015 Slotte ..... H04M 1/035 381/352

(Continued)

*Primary Examiner* — David L Ton
(74) *Attorney, Agent, or Firm* — IPro, PLLC; Na Xu

(57) ABSTRACT

The present disclosure provides a speaker box including a lower cover, an upper cover, a sounding unit, a blocking wall, a surrounding wall, a communication hole and a gas permeable spacer. The sounding unit, the lower cover and the upper cover enclose a rear chamber. The rear chamber is partitioned into a first rear chamber and a second rear chamber by the blocking wall. The sounding unit is accommodated in the first rear chamber. A sound absorbing chamber having a gas permeable spacer is formed in the first rear chamber. The blocking wall has a communication hole that communicates the sound absorbing chamber with the second rear chamber, and the second rear chamber and the sound absorbing chamber are filled with sound absorbing particles. Compared with the related art, the speaker box of the present disclosure has a simple structure and excellent audio performance, especially excellent low frequency performance.

9 Claims, 3 Drawing Sheets

(56) References Cited

U.S. PATENT DOCUMENTS

| | | | | |
|---|---|---|---|---|
| 2015/0304747 | A1* | 10/2015 | Wang | H04R 5/02<br>381/345 |
| 2016/0261949 | A1* | 9/2016 | Liu | H04R 1/2842 |
| 2018/0255393 | A1* | 9/2018 | Wang | H04R 1/2819 |
| 2018/0302731 | A1* | 10/2018 | Liu | H04R 31/00 |

* cited by examiner

SPEAKER BOX

CROSS-REFERENCE TO RELATED APPLICATIONS

The present application claims priority to Chinese Patent Application No. 201810012546.7, filed on Jan. 5, 2018, the content of which is incorporated herein by reference in its entirety.

TECHNICAL FIELD

The present disclosure relates to the electric and acoustic field and, in particular, to a speaker box applied to portable electronics.

BACKGROUND

With the advent of the mobile internet era, the number of smart mobile devices is continuously increasing. Among various mobile devices, mobile phones are undoubtedly the most common and portable mobile terminal device. At present, the functions of mobile phones are extremely diverse, one of which is a high-quality music function, so that the speaker box for playing sound is widely applied to the existing smart mobile devices.

The speaker box in the related art includes a lower cover, an upper cover that is combined with the lower cover to form an accommodating space, a sounding unit accommodated in the accommodating space, and a blocking wall extending from the upper cover to the lower cover. The sounding unit includes a diaphragm. The diaphragm side of the sounding unit faces the upper cove. The diaphragm and the upper cover enclose a front chamber. The sounding unit, the lower cover and the upper cover jointly encloses a rear chamber. The blocking wall encloses an auxiliary sounding chamber. A gas permeable spacer is attached to a side of the blocking wall close to the lower cover. A D-BASS virtual sounding chamber is formed by filling the auxiliary sounding chamber with sound absorbing particles, thereby improving the low frequency acoustic performance of the speaker box.

However, in the speaker box of the related art, the gas permeable spacer is fixed to the blocking wall by a hot-melt method. Because of the irregular structure of the speaker box, part of the space cannot be effectively utilized, the formed virtual acoustic chamber is limited in volume, and improvement for audio performance is further limited.

In a speaker box with another structure in the related art, a through hole communicating with the virtual acoustic chamber is established in the above upper cover, and a cover plate is provided to cover and seal the through hole. Although the volume of the virtual acoustic chamber is increased to some extent, the improvement effect is small, and the additional mold cost of the cover plate is required, so that the production cost is increased.

Therefore, it is necessary to provide a new speaker box to solve the above technical problems.

BRIEF DESCRIPTION OF DRAWINGS

In order to more clearly illustrate technical solutions of embodiments of the present disclosure, the accompanying drawings used in the embodiments are briefly described below. The drawings described below are merely a part of the embodiments of the present disclosure. Based on these drawings, those skilled in the art can obtain other drawings without any creative effort.

DESCRIPTION OF EMBODIMENTS

The technical solutions in the embodiments of the present disclosure are clearly and completely described in details with reference to the accompanying drawings. The described embodiments are merely part of the embodiments of the present disclosure rather than all of the embodiments. All other embodiments obtained by those skilled in the art based on the embodiments of the present disclosure without paying creative labor shall fall into the protection scope of the present disclosure.

Figure 1:
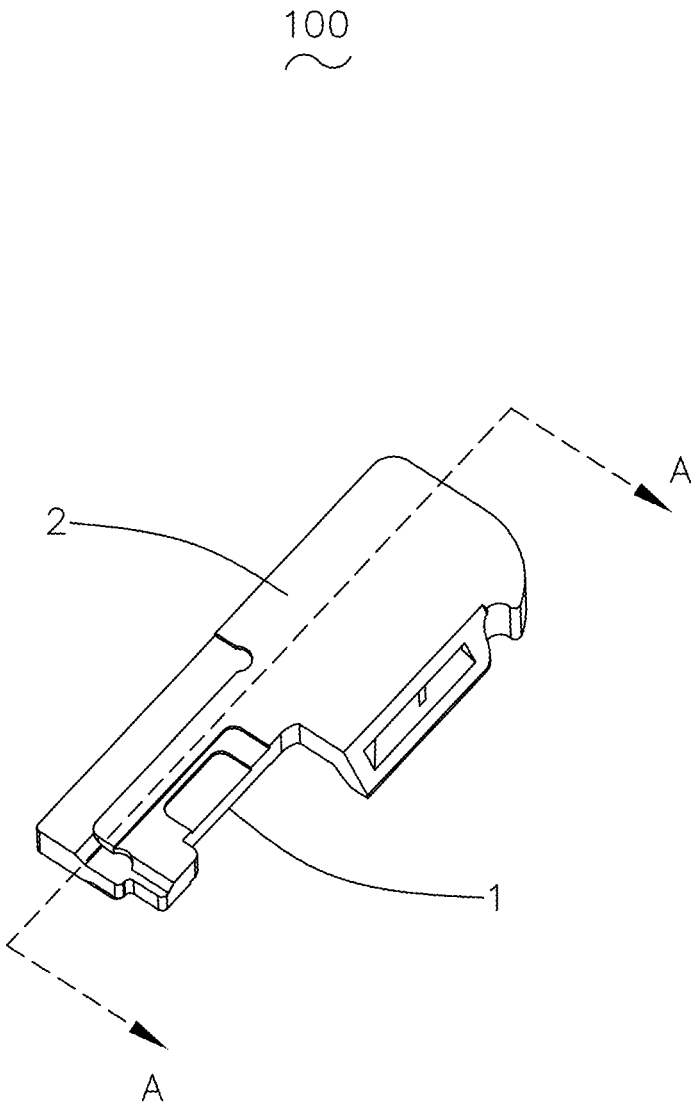
FIG. 1 is a perspective schematic diagram showing a speaker box according to an embodiment of the present disclosure.
Figure 2:
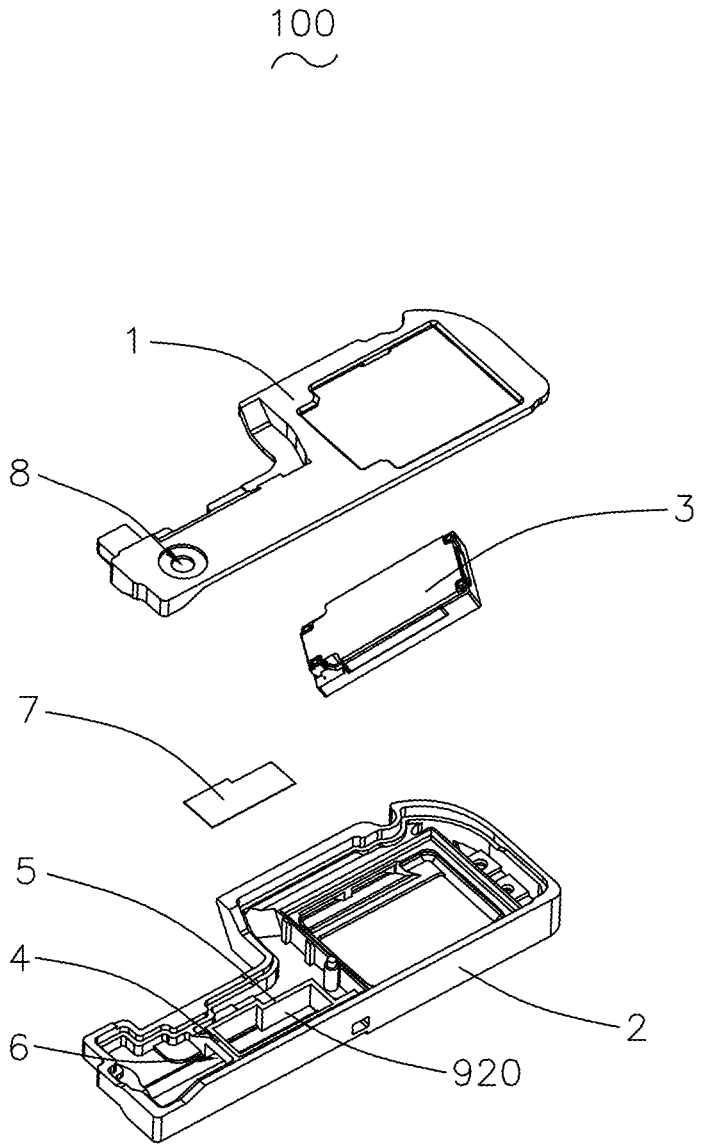
FIG. 2 is an exploded view of the speaker box in FIG. 1.
Figure 3:
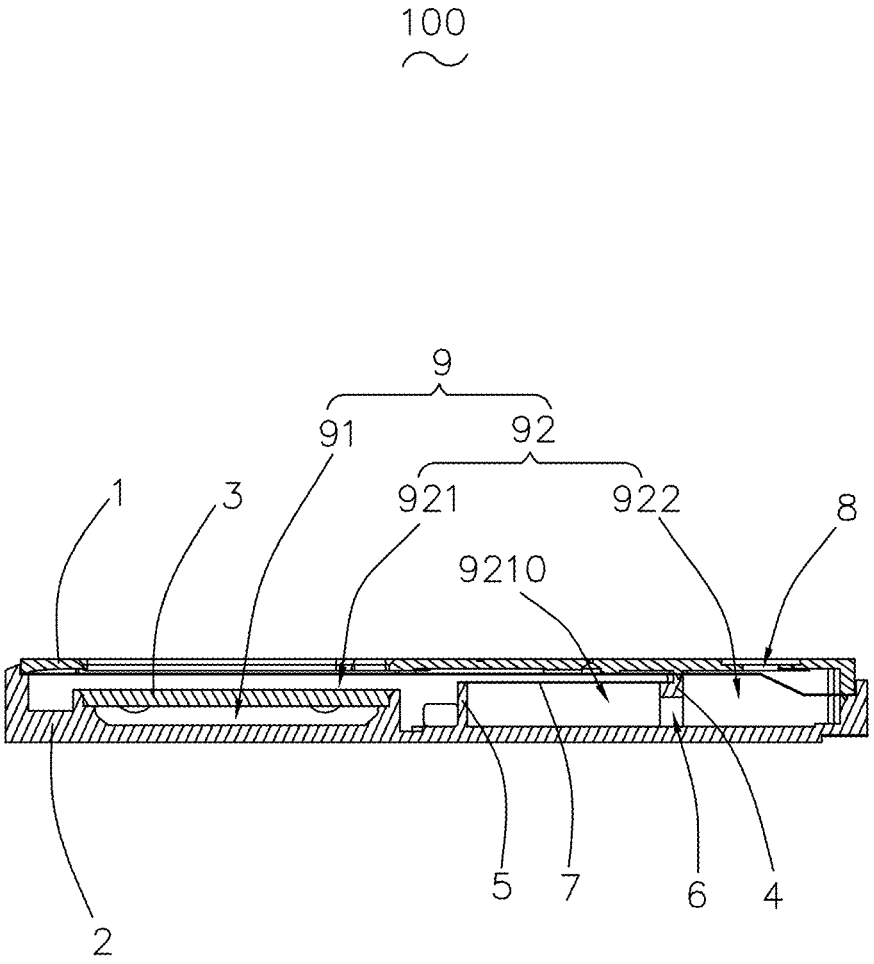
FIG. 3 is a cross-sectional view taken along line A-A in FIG. 1.

Referring to FIGS. 1-3, an embodiment of the present disclosure provides a speaker box 100 including a lower cover 1, an upper cover 2, a sounding unit 3, a blocking wall 4, a surrounding wall 5, a communication hole 6, a gas permeable spacer 7, and a filling hole 8.

It should be noted that, in the embodiment of the present disclosure, the upper cover 2 is disposed opposite to a sounding side (a side on which a diaphragm is provided) of the sounding unit 3.

The lower cover 1 and the upper cover 2 are assembled together to form an accommodating space 9. Specifically, the lower cover 1 is fixed to and sealed with the upper cover 2 by an ultrasonic welding process.

The sounding unit 3 is accommodated in the accommodating space 9. The sounding unit 3 and the upper cover 2 enclose a front chamber 91 for sounding. The sounding unit 3, the lower cover 1 and the upper cover 2 enclose a rear chamber 92 in order to improve low frequency acoustic performance. That is, the accommodating space 9 is partitioned into the front chamber 91 and the rear chamber 92 by the sounding unit 3.

Specifically, in an embodiment of the present disclosure, the blocking wall 4 extends from the upper cover 2 to the lower cover 1 and abuts against the lower cover 1. The blocking wall 4 is fixed to and sealed with the lower cover 1 by an ultrasonic welding process. The rear chamber 92 is partitioned into a first rear chamber 921 and a second rear chamber 922 by the blocking wall 4.

The surrounding wall 5 is spaced apart from the sounding unit 3, and extends from the upper cover 2 into the first rear chamber 921. The surrounding wall 5 and the blocking wall 4 together enclose an opening 920 directly facing the lower cover 1. The gas permeable spacer 7 is fixed to and covers the opening 920. In an embodiment of the present disclosure, the gas permeable spacer 7 is fixed to and sealed with the surrounding wall 5 by a hot-melt method. The gas permeable spacer 7, the surrounding wall 5 and the blocking wall 4 enclose a sound absorbing chamber 9210. The sound absorbing chamber 9210 communicates with the first rear chamber 921 via the gas permeable spacer 7. The gas permeable spacer 7 is spaced apart from the lower cover 1.

The blocking wall 4, the upper cover 2 and the lower cover 1 jointly encloses the second rear chamber 922 serving as a virtual acoustic chamber. That is, the second rear chamber 922 is filled with sound absorbing particles (not shown) such that the second rear chamber 922 forms a D-BASS virtual acoustic chamber. In this case, the formation of the second rear chamber 922 is not restricted by the structure and shape of the speaker box 100, and the second rear chamber 922 can be fully filled with the sound absorbing particles, thereby maximizing volume space thereof.

The surrounding wall 5, the upper cover 2, the gas permeable spacer 7 and the blocking wall 4 jointly enclose a sound absorbing chamber 9210 which serves as a virtual acoustic chamber and is in air communication with the first rear chamber 921. That is, the sound absorbing chamber 9210 is filled with sound absorbing particles (not shown) such that the sound absorbing chamber 9210 forms a D-BASS virtual acoustic chamber. In this case, the sound absorbing chamber 9210 does not have to form an exposed structure with an additional mold, thus has a simple structure and a lower production cost.

On the basis of an irregular shape of the speaker box 100 and the second rear chamber 922, other space of the second rear chamber 922 is fully utilized to form a virtual acoustic chamber, which effectively increases the volume of the virtual acoustic chamber. That is, the acoustic performance of the speaker box 100 is greatly improved.

It should be noted that said "air communication" means that only air can circulate between the sound absorbing chamber 9210 and the first rear chamber 921 through the gas permeable spacer 7, and other objects cannot enter into them.

In an embodiment of the present disclosure, optionally, the upper cover 2, the blocking wall 4 and the surrounding wall 5 are integrally formed. It is also conceivable that they are separately formed structures and are then assembled and fixed together.

The communication hole 6 extends through the blocking wall 4 so that the second rear chamber 922 communicates with the sound absorbing chamber 9210. That is, after both the second rear chamber 922 and the sound absorbing chamber 9210 are filled with the sound absorbing particles, the sound absorbing particles can circulate between them.

The above structure of the speaker box 100 of the present disclosure can greatly increase the amount of sound absorbing particles filled into the virtual acoustic chamber, thereby reducing a resonant frequency and improving low frequency sensitivity. The acoustic performance of the speaker box according to the present disclosure and the speaker box in the related art (i.e., the speaker box structure mentioned in the background) are listed in the following table.

Acoustic performance parameters of the speaker box with the above structure of the present disclosure and the speaker box of the related art

| Speaker box | Volume of Sound absorbing particles | Resonant frequency F0 | Sound pressure level SPL500 Hz | Sound pressure level SPL1.5 KHz |
|---|---|---|---|---|
| related art 1 | 0.15 cc | 823.6 Hz | 83 dB | 92 dB |
| related art 2 | 0.20 cc | 794.5 Hz | 83.4 dB | 91.6 dB |
| the present disclosure | 0.25 cc | 752.4 Hz | 83.9 dB | 93.8 dB |

In an embodiment of the present disclosure, the second rear chamber 922 is located on a side of the sound absorbing chamber 9210 away from the first rear chamber 921, so that a rear end of the second rear chamber 922 (i.e., the second rear chamber 922) can be fully filled with powders, which can suppress a standing wave of the rear chamber 92, thereby eliminating the frequency valley in the sound pressure level curve, i.e., improving the acoustic performance.

In an embodiment of the present disclosure, the communication hole 6 is formed by a slanting roof molding process, and has a rectangular shape. It is conceivable that the shape of the communication hole 6 is not limited thereto, and may be other shapes such as a circle or the like.

Optionally, in an embodiment of the present disclosure, the gas permeable spacer 7 is a mesh cloth. Of course, it is not limited thereto, as long as it can prevent the sound absorbing particles from entering the first rear chamber 921 and is permeable for sound and air.

The filling hole 8 extends through the lower cover 1, and is in communication with the second rear chamber 922. The sound absorbing particles are filled into the second rear chamber 922 and the sound absorbing chamber 9210 through the filling hole 8, such that the second rear chamber 922 and the sound absorbing chamber 9210 form the D-BASS virtual sound chamber.

After sound enters the second rear chamber 922 and the sound absorbing chamber 9210 from the first rear chamber 921, the transmission path thereof is increased by the sound absorbing particles so as to improve the audio performance of the speaker box 100, especially the low frequency acoustic performance. Specifically, in an embodiment of the present disclosure, the sound absorbing particles are dust, zeolite particles or the like.

Compared with the related art, the rear chamber of the speaker box of the present disclosure is further added with the blocking wall extending from the upper cover to the lower cover, and the surrounding wall, so that the blocking wall, the upper cover and the lower cover together enclose a second rear chamber that serves as a virtual acoustic chamber, and the second rear chamber is not limited by the structure of the speaker box. Meanwhile, the surrounding wall, the upper cover, the gas permeable spacer and the blocking wall enclose a sound absorbing chamber that serves as a virtual acoustic chamber and is in air communication with the first rear chamber, so that the sound absorbing chamber can be molded without additional mold structure of the customer, resulting in a simple structure, a reduced production cost, and an effective increase of the volume of the virtual acoustic chamber. Such structural arrangement can achieve a separate maximization of the virtual acoustic chamber, thereby effectively improving the low frequency acoustic performance of the speaker box.

The above are merely embodiments of the present disclosure. Here, it should be noted that those skilled in the art can make modifications without departing from the inventive concept of the present disclosure, but these modifications shall fall into the protection scope of the present disclosure.

What is claimed is:

1. A speaker box, comprising:

a lower cover;

an upper cover that is assembled with the lower cover to form an accommodating space;

a sounding unit accommodated in the accommodating space, wherein the sounding unit and the upper cover enclose a front chamber, and the sounding unit, the lower cover and the upper cover enclose a rear chamber;

a blocking wall that extends from the upper cover to the lower cover and abuts against the lower cover, wherein the rear chamber is partitioned into a first rear chamber and a second rear chamber by the blocking wall, and the sounding unit is fixed in the first rear chamber;

a surrounding wall extending from the upper cover into the first rear chamber, wherein the surrounding wall and the blocking wall enclose an opening; and a gas permeable spacer covering the opening, wherein the gas permeable spacer, the surrounding wall and the blocking wall enclose a sound absorbing chamber, and the sound absorbing chamber communicates with the first rear chamber via the gas permeable spacer, the blocking wall has a communication hole that communicates the sound absorbing chamber with the second rear chamber, and the second rear chamber and the sound absorbing chamber are filled with sound absorbing particles.

2. The speaker box as described in claim 1, wherein both the upper cover and the blocking wall are fixed to and sealed with the lower cover by an ultrasonic welding process.

3. The speaker box as described in claim 1, wherein the gas permeable spacer is fixed to and sealed with the surrounding wall by a hot-melt method.

4. The speaker box as described in claim 1, wherein the communication hole is formed in the blocking wall by a slanting roof molding process.

5. The speaker box as described in claim 1, wherein the gas permeable spacer is a mesh cloth.

6. The speaker box as described in claim 1, further comprising a filling hole extending through the lower cover, wherein the filling hole is in communication with the second rear chamber, and the sound absorbing particles are filled into the second rear chamber and the sound absorbing chamber through the filling hole.

7. The speaker box as described in claim 1, wherein the sound absorbing particles are zeolite particles.

8. The speaker box as described in claim 1, wherein the surrounding wall is spaced apart from the sounding unit.

9. The speaker box as described in claim 1, wherein the opening directly faces the lower cover, and the gas permeable spacer is spaced apart from the lower cover.

* * * * *